US005240770A

United States Patent [19]

Moriga et al.

[11] Patent Number: 5,240,770

[45] Date of Patent: Aug. 31, 1993

[54] SURFACE-MODIFIED WHOLLY AROMATIC POLYAMIDE FIBER AND METHOD OF PRODUCING SAME

[75] Inventors: Hiroyuki Moriga, Takatsuki; Shoji Makino, Ibaraki; Akira Kimura, Matsuyama; Hirosuke Watanabe, Ibaraki; Tadashi Hirakawa, Suita, all of Japan

[73] Assignee: Teijin Limited, Osaka, Japan

[21] Appl. No.: 758,166

[22] Filed: Sep. 11, 1991

Related U.S. Application Data

[63] Continuation of Ser. No. 317,922, Mar. 2, 1989, abandoned.

[30] Foreign Application Priority Data

Mar. 2, 1988 [JP] Japan ..... 63-47561
Mar. 10, 1988 [JP] Japan ..... 63-54946

[51] Int. Cl.[5] ..... D02G 3/00; B05D 1/12

[52] U.S. Cl. ..... 428/372; 428/375; 428/387; 428/391; 428/395; 428/400; 523/212; 523/213; 427/180; 427/201

[58] Field of Search ..... 428/395, 372, 400, 375, 428/391, 389, 373; 523/212, 213; 427/180, 201

[56] References Cited

U.S. PATENT DOCUMENTS

| | | | |
|---|---|---|---|
| 4,405,727 | 9/1983 | Brownscombe | 428/333 |
| 4,522,873 | 6/1985 | Akazi et al. | 428/372 |
| 4,751,760 | 6/1988 | Norota | 428/397 |
| 4,762,751 | 8/1988 | Girgis et al. | 428/392 |

FOREIGN PATENT DOCUMENTS

| | | | |
|---|---|---|---|
| 0028391 | 10/1980 | European Pat. Off. | 523/212 |
| 35835 | 9/1981 | European Pat. Off. | 428/400 |
| 0121132 | 10/1984 | European Pat. Off. . | |
| 129317 | 12/1984 | European Pat. Off. | 428/400 |
| 0168066 | 1/1986 | European Pat. Off. . | |
| 3303376A1 | 8/1984 | Fed. Rep. of Germany . | |
| 0201807 | 11/1983 | Japan | 523/212 |
| 435529 | 4/1968 | Switzerland . | |

*Primary Examiner*—Patrick J. Ryan
*Assistant Examiner*—J. M. Gray
*Attorney, Agent, or Firm*—Burgess, Ryan & Wayne

[57] ABSTRACT

A surface-modified wholly aromatic polyamide fiber having an enhanced bonding property, surface tenacity and durability and a reduced friction, comprises a fiber matrix of a wholly aromatic polyamide material, fine particles of a cation-exchanging inorganic material distributed on and in a surface portion of the matrix and an additive comprising a cationic organic compound or a multi-functional organic silicone compounds, and attached to the fine organic particles.

9 Claims, 1 Drawing Sheet

SURFACE-MODIFIED WHOLLY AROMATIC POLYAMIDE FIBER AND METHOD OF PRODUCING SAME

This application is a continuation of application Ser. No. 317,922, filed Mar. 2, 1989, now abandoned.

BACKGROUND OF THE INVENTION (1) Field of the Invention

The present invention relates to a surface-modified wholly aromatic polyamide fiber and a method of producing same. More particularly, the present invention relates to a wholly aromatic polyamide fiber surface-modified with cation-exchanging inorganic fine particles and a specific additive attached to the fine particles and thus useful for fiber-reinforced rubber or synthetic resinous materials, and a method of producing the same.

(2) Description of Related Arts

It is known that wholly aromatic polyamide fibers have an excellent heat-resistance, a superior mechanical strength, a high elastic modulus and satisfactory chemical resistance and electric property, and thus are usable for various composite materials.

The wholly aromatic polyamide fiber, i.e., the aramide fiber, exhibits a superior mechanical strength in a direction parallel to the longitudinal axis of the fiber, but in a direction transverse to the longitudinal axis of the fiber, the aramide fiber is easily fibrillated due to very high degrees of orientation and crystallinity of the aramide polymer molecules in the fiber. Also, due to this high degree of crystallinity, the surface of the aramide fiber exhibits a poor interface bonding to other materials.

Accordingly, to eliminate the above-mentioned disadvantages, various attempts have been made to improve the surface property of the aramide fiber.

For example, Japanese Unexamined Patent Publication (Kokai) No. 62-97967 discloses a method of producing a wholly aromatic polyamide shaped article having an enhanced bonding property to an organic polymeric matrix, comprising the step of treating a surface of the wholly aromatic polyamide shaped article with an aqueous solution of a metal salt of hypochlorous acid.

Also, Japanese Unexamined Patent Publication (Kokai) No. 62-243620 discloses a surface-modified wholly aromatic polyamide shaped article in which a portion of or all of amide radicals located in a surface portion of a wholly aromatic polyamide shaped article comprising recurring units of the general formula: —NH—$Ar_1$—CONH—$A_2$—CO— and/or —NH—$Ar_3$—CO—, wherein $Ar_1$, $Ar_2$, and $Ar_3$ respectively and independently from each other represent a divalent aromatic group, are replaced at the nitrogen atoms by an aliphatic organic radical having 2 to 10 carbon atoms.

Further, Japanese Unexamined Patent Publication (Kokai) No. 62-243628 discloses a method of producing a surface-modified wholly aromatic polyamide shaped article, characterized by treating a wholly aromatic polyamide shaped article with an alkali metal salt or alkaline earth metal salt of an aromatic or aliphatic hydrocarbon to convert at least a portion of the amide radicals located in the surface portion of the article to a metal salt radical, and to cause the surface portion of the article to swell, and then treating the surface portion of the article with a polyepoxy compound having at least three epoxy radicals per polymer molecule of the polyamide.

The above-mentioned attempts do not always produce a satisfactory surface-property of the resultant wholly aromatic polyamide fiber.

Particularly, when the wholly aromatic polyamide fibers are converted to a paper-like sheet or nonwoven fabric and are used as reinforcing materials for resinous shaped articles, the fibers usually exhibit a poor resistance to organic solvents for matrix resins of the shaped articles, and thus the reinforcing materials are frequently broken in the step in which the reinforcing materials are impregnated with a solution of a resinous material in the organic solvent.

Also, the reinforcing materials made from the wholly aromatic polyamide fibers exhibit a poor bonding to the matrix resin, and therefore, in a resultant fiber-reinforced shaped article, the reinforcing material is easily peeled from the resinous matrix.

Accordingly, there is a strong demand for a new type of wholly aromatic polyamide fibers having not only a high mechanical strength and elastic modulus but also an enhanced bonding property to another resinous matrix, and thus useful as reinforcing materials for various resinous or rubber articles.

SUMMARY OF THE INVENTION

An object of the present invention is to provide a surface-modified wholly aromatic polyamide fiber having an activated surface which exhibits an enhanced bonding or adherence to another resinous material, and an improved resistance to organic solvents, and a method of producing same.

The above-mentioned object can be attained by the surface-modified wholly aromatic polyamide fiber of the present invention, which comprises:

a fiber matrix comprising a wholly aromatic polyamide material;

fine inorganic particles distributed on and in a surface portion of the matrix and comprising at least one cation-exchanging inorganic material, and an additive attached to the fine inorganic particles and comprising at least one member selected from the group consisting of cationic organic compounds and organic silicone compounds having at least two different types of reactive radicals.

The above-mentioned surface-modified wholly aromatic polyamide fiber can be produced by the method of the present invention which comprises:

converting a wholly aromatic polyamide material to a fiber through a spinning (fiber-forming) step, at least one drawing step, and at least one heat-treating step; and at any stage after the spinning step, applying fine inorganic particles comprising at least one cation-exchanging inorganic material to surface of the fiber; and treating the fine inorganic particles adhered to the surface of the fiber with an additive comprising at least one member selected from the group consisting of cationic organic compounds and organic silicone compounds having at last two different types of reactive radicals to cause the additive to be attached to the fine inorganic particles.

DESCRIPTION OF THE PREFERRED EMBODIMENTS

Figure 1:
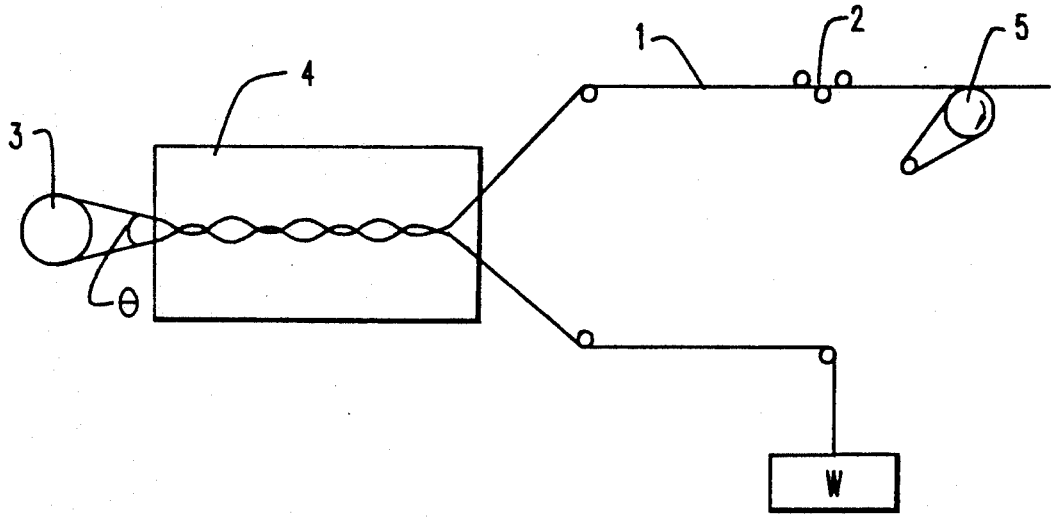
FIG. 1 shows an essential structure of an apparatus for measuring a static friction between fibers.

The wholly aromatic polyamide fiber can be produced from a wholly aromatic polyamide material by a usual method comprising a spinning (fiber-forming) step, at least one drawing step, and at least one heat-treating step.

The wholly aromatic polyamide material preferably comprises at least one wholly aromatic polyamide polymer having 80 to 100 molar % of principal recurring units of the formula (1):

$$-NH-Ar_1-NHCO-Ar_2-CO- \quad (1)$$

wherein $Ar_1$ and $Ar_2$ represent, respectively and independently from each other, a member selected from the group consisting of the ingredients of the formula (A), (B) and (C):

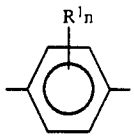
(A)

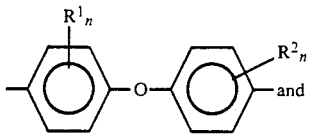
(B)

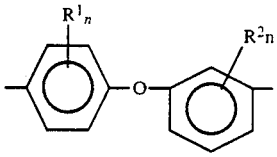
(C)

in which $R^1$ and $R^2$ represent respectively and independently from each other a member selected from the group consisting of halogen atoms, for example, chlorine atom and bromine atom, and a lower alkyl radical having 1 to 2 carbon atoms, for example, methyl or ethyl radical, and n represents zero or an integer of 1 to 4.

The wholly aromatic polyamide polymer may be a homopolymer or a copolymer.

The wholly aromatic polyamide polymer may have 0 to 20 molar % of additional recurring units, in addition to 80 to 100 molar % of the principal recurring units of the formula (1).

The additional recurring units may be selected from those of the formulae (2) and (3):

$$\text{+}NH-Ar_3-CO\text{+} \text{ and} \quad (2)$$

$$\text{+}NH-Ar_4-NHCO-Ar_5-CO\text{+} \quad (3)$$

wherein $Ar_3$, $Ar_4$ and $Ar_5$, respectively and independently from each other, represent an unsubstituted or substituted divalent aromatic radical selected from those of the formulae:

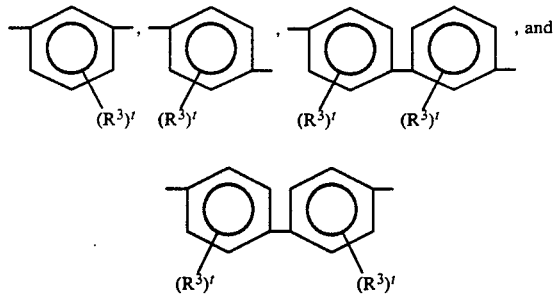
, and in which $R^3$ represents a member selected from the group consisting of lower arkyl radicals having 1 to 3 carbon atoms, lower alkoxy radicals having 1 to 3 carbon atoms, halogen atoms and nitro radicals, and t represents zero or an integer of from 1 to 3, and $Ar_4$ and $Ar_5$ are different from $Ar_1$ to $Ar_2$.

The above-mentioned wholly aromatic polyamide homopolymer and copolymer can be prepared by known methods, for example, as disclosed by British Patent No. 1,501,948, U.S. Pat. No. 3,733,964 or Japanese Unexamined Patent Publication No. 49-100322.

In the wholly aromatic polyamide polymer, the principal recurring units of the formula (1) preferably comprise the ingredients of the formulae (A) and (B) in the total content of 80 to 100 molar % and the ingredient of the formula (B) is in a content of 10 to 40 molar %, based on the total content of the ingredients represented by $Ar_1$ and $Ar_2$.

The cation-exchanging inorganic material usable for the present invention preferably comprises at least one member selected from the group consisting of silica-alumina, silica-magnesia, bentnite, kaolin, fuller's earth, activated clay, montmorilonite, halloysite, talc and a mixture of an inorganic material comprising, as a major component, hydrated magnesium silicate and a hydrated gel-forming inorganic material.

The cation-exchanging inorganic compound is in the form of fine solid particles and is easily adhered on a surface of the wholly aromatic polyamide fiber.

The fine inorganic particles preferably have a size of 0.01 to 5 μm, more preferably, 0.01 to 3 μm.

If the size is excessively large, the adhesion of the fine inorganic particles on the surface of the wholly aromatic polyamide fiber will be undesirably poor.

The inorganic material comprising, as a major component, hydrated magnesium silicate may be talc and may preferably have a particle size of 0.01 to 3 μm.

The hydrated gel-forming inorganic material refers to an inorganic material which forms a substantially non-fluid or semi-fluid gel when hydrated with water in an amount of five times the weight of the material. Specifically, the hydrated gel-forming inorganic compound comprises, as a major component, aluminum silicate. The fine inorganic particles are applied in an amount of 0.1% to 5% based on the weight of the fiber matrix (non-surface modified fiber).

The fine inorganic particles can be applied to the surface of the fiber at any stage after the spinning (fiber-forming step).

For example, the fine inorganic particles can be applied to the fiber surface while the fiber is softened or plasticized, so that the particles are adhered, pierced or embedded on or in the surface portion of the fiber. The fiber may be an undrawn fiber immediately after the spinning step but before complete cooling or a heated undrawn fiber.

For example, the fine inorganic particles are blown toward the surface of the undrawn fiber or the undrawn fiber is immersed in an aqueous slurry containing the fine inorganic particles, to allow the fine inorganic particles to adhere to the fiber surface, and then the undrawn fiber adhered with the fine inorganic particles is dried, if necessary, and drawn at a temperature higher than the glass transition temperature of the wholly aromatic polyamide polymer, at a draw ratio, for example, of 5 or more, by using a contact type or non-contact type heater. This process is effective for piercing or pushing the fine inorganic particles into the surface portion of the fiber, and for fixing the particles in the fiber surface portion.

The application of the fine inorganic particles can be effected to a drawn fiber surface and then a heat treatment can be applied to the fine inorganic particle-applied fiber surface at an elevated temperature.

Preferably, the fine inorganic particles are applied in an amount of 0.1% to 5%, more preferably 0.1% to 2%, based on the weight of the fiber matrix (non-surface modified fiber).

Alternatively, the fine inorganic particles are applied onto a drawn fiber surface and the applied drawn fiber is then further drawn or heat-treated at an elevated temperature.

The fine inorganic particle-applied fiber is further treated with an additive comprising at least one member selected from the group consisting of cationic organic compounds and organic silicone compounds having at least two different types of reactive radicals. The additive is attached to the fine inorganic particles on the fiber surface.

The cationic organic compounds refer to electron-donating organic compounds and include amino-radical-containing organic compounds and tert-cationic radical-containing organic compounds.

In a conventional treatment, a silicone compound is directly applied to a fiber surface to reduce a surface friction or to increase a surface tenacity. When this treatment is applied to the wholly aromatic polyamide fiber surface, however, the effect of the treatment is only temporary. Also, a large amount of the silicone compound must be applied to the fiber surface. This phenomenon is due to a poor affinity of the usual silicone compound to the wholly aromatic polyamide fiber surface. In the present invention, the fine inorganic particles fixed on the fiber surface exhibit a high affinity to the cationic organic compounds or a specific organic silicone compounds having two or more different types of reactive radicals.

The cationic organic compound may be a modified silicone compound having an amino radical or a ter-tonium radical. The organic cationic silicone compound exhibits a very high reactivity to the cation-exchanging inorganic fine particles and form a very stable and durable film on the fiber surface. That is, the film of the organic cationic silicone compounds has a high resistance to water-washing, laundering and dry cleaning, and is effective for decreasing surface friction and increasing a surface tenacity of the fiber.

For example, when an amino-modified silicone compound is applied in an amount of 1.0% or less based on the non-surface modified fiber, a friction between fibers is significantly decreased. When an amino-modified silicone polymer having a molecular weight of 10,000 or less, is applied in an amount of less than 1.0% based on the non-surface modified fiber, the resultant surface-modified fiber exhibits a significantly enhanced surface tenacity. These phenomena teach that the amino-modified silicone compound can form a regularly oriented membrane or film firmly fixed by the cation-exchanging sites of the fine inorganic particles.

As mentioned above, the fine organic particles of the cation-exchanging inorganic material are effective for imparting an enhanced bonding or adhesive activity to the wholly aromatic polyamide fiber surface which, per se, has a very poor bonding or adhesive property.

For example, it is known that a polyalkylene amine compound is usable as a bonding agent for polyester fibers or aramide fibers with a rubber material. The bonding property of the aramide fiber surface to the polyalkylene amine compound can be increased by applying the cation-exchanging fine inorganic particles to the fiber surface. This is true not only for the polyalkylene amine compounds but also for polyamide amine compounds.

The cationic organic compounds usable for the present invention include epoxy-containing-amino compounds, for example, tetraepoxy compounds of xylylene diamine and cyclohexylene diamine which are available under trademarks of TETRAD-X and TETRAD-C, made by Mitsubishi Gas Chemical Co., Inc.; tetraepoxy compounds of diethylenetriamine, which is available under a trademark of EPO TOHTO Y-H-434, made by Tohto Kasei K.K., and tetraepoxy compounds of aromatic diamines which are available under trademarks of Sumiepoxy ELM-434 and ELM-434HV, made by Sumitomo Chemical.

The cationic organic compound include tert-cationic onium radical-modified organic compounds and polymers, for example, water soluble, tert-onium radical-containing polyurethane polymers.

The above-mentioned cationic organic compounds can be firmly fixed by the cation-exchanging sites of the fine inorganic particles applied to the wholly aromatic polyamide fiber surface to modify the fiber surface to that having a high durable abrasion resistance and an enhanced durable bonding property. In other words, the surface of the wholly aromatic polyamide fiber can be imparted a specific property and function of the cationic organic compound in accordance with the present invention.

Alternatively, the fine inorganic particle-applied fiber surface is treated with an organic silicone compound having two or more different types of reactive radicals.

The organic silicone compound is preferably selected from silane-coupling compounds of the general formula (2):

$$R_m—Si—X_l \quad (2)$$

where R represents a member selected from the group consisting of epoxy, amino, isocyanate and vinyl radicals, X represents a member selected from the group consisting of methoxy, ethoxy and ethylene-glycol monoether radicals, l and m respectively represent an integer of 1, 2 or 3, and the sum of l and m must be 4. The silicone compounds of the formula (2) are, for example, γ-glycidyldoxpropyltrimethoxy silane, γ-amino-propyltriethoxy silane, and vinyltrimethoxy silane.

The additive is applied in an amount of 0.1 to 5% based on the weight of the non-surface modified fiber.

The additive of the present invention may be applied alone or together with another fiber treating agent or oiling agent.

The additive of the present invention is applied in the form of a straight, an aqueous emulsion or an organic solvent solution, and in a usual manner, for example, roller coating, spraying or metalling extrusion.

Further, the fine inorganic particle-applied fiber can be treated in the form of a fiber, filament yarn, paper-like sheet, nonwoven fabric, woven fabric or knitted fabric by the additive. After the treatment is completed, the additive-treated fiber or fiber material may be heat-treated at an elevated temperature, for example, 120° C. to 150° C., for 30 sec to 180 sec.

The surface-modified wholly aromatic polyamide fiber is advantageous in the following points.

1. Friction between fibers is very low.
2. A bonding property to rubber or polymeric article is very high.
3. A surface tenacity is high.
4. A resistance to fibrillation is excellent.
5. The modified surface layer has an increased resistance to polar organic solvents, for example, dimethylformamide (DMF), dimethylsulfoxide (DMSO) and N-methyl pyrrolidone (NMP).

EXAMPLES

The present invention will be further explained by the following specific examples, which are intended to be representative rather than restrictive of the scope of the present invention.

In the examples, the resistances of the modified surface of the wholly aromatic polyamide fiber to water-washing and detergent-laundering, the strength of the surface-modifying coating membrane, and the bonding property of the surface-modified fiber are tested as follows.

(1) Resistance to washing with water

A specimen (surface-modified fibers) in an amount of about 3 g was treated with ultrasonic vibration in a solution of 1% by weight of a non-ionic surface active agent consisting of nonylphenol attached with 10 moles of ethylene oxide per mole of the nonyl phenol, at a liquor ratio of 1:100 and at room temperature for one minute or ten minutes.

The frictional property or the bonding property of the washed fibers was compared with that of the non-washed fibers, and the results evaluated as follows:

| Class | |
|---|---|
| 3 | Substantially no or slight change in the surface modification effect |
| 2 | Surface modification effect decreased in intensity by about 50% |
| 1 | Surface modification effect substantially complete lost. |

(2) Resistance to organic solvent

A specimen consisting of about 3 g of fibers adhered with cation-exchanging fine inorganic particles was treated with cyclohexane at the boiling temperature thereof for 3 hours.

The results were evaluated in the same manner as mentioned above.

(3) Surface tenacity

The surface tenacity of the surface-modified fibers was represented by a static friction between the fibers.

Referring to FIG. 1, a fiber 1 was loaded at an end thereof with a weight of 1 kg, the fiber 1 was then wound around a pully 3, twisted on a heating plate 4 at room temperature or 200° C. at a twist number n, and then taken up through a taking up roller 5 at a speed of 10 cm/min. A taking up tension $T_2$ created on the fiber 1 was measured by a tension meter 2.

In the entrance of the twisting zone, the coming-in portion of the fiber 1 intersected the going-out portion thereof at an intersecting angle of 20 degrees.

The static friction in kg between the coming-in and going-out portions of fiber 1 was determined from the tension ($T_2$-1).

(4) Bonding property

The bonding property of the surface-modified fibers was represented by a retention of tensile strength of the fibers.

An adhesive solution was prepared in accordance with the following composition.

| Composition of adhesive agent | | |
|---|---|---|
| Component | Concentration (% by wt) | Amount (part by wt) |
| Water | 100 | 223.5 |
| Resorcinol | 100 | 17.0 |
| Formaldehyde | 37 | 5.6 |
| Sodium hydroxide | 10 | 1.3 |
| Latex (1) | 40 | 90.0 |
| Latex (2) | 40 | 22.5 |
| Surfactant | 20 | 90.0 |

Note:
Latex (1) . . . Trademark: Nippol 2518FS, made by Nihon Zeon Co.
Latex (2) . . . Trademark: Nippol LX-112, made by Nihon Zeon Co.
Surfactant . . . Trademark: PEXUL, made by Nihon ICI Co.

The solid content of the adhesive solution was adjusted to 16% by weight.

A cord consisting of surface-modified fibers was immersed in the adhesive solution, and the cord impregnated with the adhesive solution was dried at 100° C. for 2 minutes at a fixed length, heat set at 230° C. for one minute while allowing the cord to shrink at a shrinkage of 3%, and then wound around a bobbin.

The tensile strength of the bonded cord was measured and the retention (R) in tensile strength of the cord was calculated in accordance with the following equation:

$$R = \frac{T_{S2}}{T_{S1}} \times 100$$

where $T_{S1}$ represents the tensile strength of the non-bonded cord and $T_{S2}$ represents the tensile strength of the bonded cord.

(5) Bonding property to rubber

Five cords consisting of the surface-modified fibers were embedded in a rubber matrix and vulcanized in a usual manner, and a peeling strength in kg/5 cm of the cord from the rubber matrix was measured.

EXAMPLES 1 TO 3 AND COMPARATIVE EXAMPLE 1

In each of Examples 1 to 3 and and Comparative Examples 1 to 3, a wholly aromatic polyamide copolymer produced from terephthalic acid dichloride, p-phenylene diamine and 3,4'-diaminodiphenylether was converted to a non-drawn multifilament bundle having a yarn count of 1000 denier/667 filaments by a usual spinning method and the multifilament bundle was repeatedly washed with water.

The multifilament bundle was immersed in an aqueous dispersion of 3% by weight of bentonite particles having an average size of 1.5 μm so that 0.42% by dry weight of bentonite particles were adhered to the fiber surfaces.

The bentonite particle-adhered multifilament bundle was drawn at a high temperature of 500° C. at a draw ratio of 10. The drawn filaments exhibited a tensile strength of 27 g/d and an ultimate elongation of 4.9%.

Immediately after the drawing step, the bentonite particle-adhered multifilament bundle was treated by an aqueous emulsion of 10% by weight of an amino-modified polysiloxane having a viscosity of 1300 cst at room temperature and an amine equivalent of 1700 in Example 1, a viscosity of 2600 cst at room temperature and an amino equivalent of 150000 in Example 2 and a viscosity of 3000 cst at room temperature and an amino equivalent of 1700, so that the amino-modified polysiloxane adhered at a dry weight of about 0.7% on the filament surfaces.

Then, the multifilament bundle was further treated with an additional aqueous emulsion containing 15% by weight of an oiling agent consisting of 60 parts by weight of isostearyl stearate, 10 parts by weight of dioleyl adipate, 15 parts by weight of hardened castor oil ether added with 20 moles of ethyleneoxide, 10 parts by weight of nonylphenyl ether added with 5 moles of ethylene oxide, and 5 parts by weight of sodium dioctylsulfosuccinate so that 1.5% by dry weight of the oiling agent adhered to the filament surfaces.

In Comparative Example 1, the same procedures as in Example 1 were carried out except that the amino-modified polysiloxane was replaced by dimethyl polysiloxane.

In Comparative Example 2, the same procedures as in Example 1 were carried out except that the amino-modified polysiloxane treatment was omitted.

In Comparative Example 3, the same procedures as in Example 2 were carried out except that the bentonite treatment was omitted.

The results of the tests are shown in Table 1.

TABLE 1

| Example No. | Resistance to Water washing | Resistance to Organic solvent | Static Friction between fibers: With oiling agent 20° C. | With oiling agent 200° C. | After removing oiling agent 20° C. | After removing oiling agent 200° C. |
|---|---|---|---|---|---|---|
| Example | | | | | | |
| 1 | 3 | 3 | 1260 | 1900 | 1250 | 1900 |
| 2 | 3 | 3 | 1200 | 1760 | 1210 | 1850 |
| 3 | 3 | 3 | 1230 | 1800 | 1200 | 1810 |
| Comparative Example | | | | | | |
| 1 | 2 | 1 | 1350 | 2050 | Broken | Broken |
| 2 | 1 | 1 | 1860 | Broken | Broken | Broken |
| 3 | 1 | 1 | 1300 | Broken | Broken | Broken |

Table 1 clearly shows that the surface modified fibers in accordance with the present invention exhibited a remarkably enhanced surface tenacity, i.e., a remarkably reduced static friction between fibers.

EXAMPLES 4 TO 6 AND COMPARATIVE EXAMPLE 4

In each of Examples 4 to 6, the same procedures as those described in Example 1 were carried out except that in the treatment of the bentonite-adhered and drawn multifilament bundle, the amino-modified polysiloxane was replaced by an aqueous solution of a polyethylene-imine having a molecular weight of 1800 and a viscosity of 8500 to 15000 cps at 25° C. and available under a trademark of SP-018, made by Nihon Shokubai K.K., in Example 8; a molecular weight of 10,000 and a viscosity of 100,000 or more cps at 25° C. and available under a trademark of SP-200, made by Nihon Shokubai K.K. in Example 5; and a molecular weight of 70,000 and a viscosity of a 30% aqueous solution thereof of 400 to 900 cps at 25° C. and available under a trademark of P-1000, made by Nihon Shokubai K.K., in Example 6.

The ethyleneimine adhered in an amount of 0.3±0.1% by dry weight to the fiber surfaces.

The oiling agent adhered in an amount of 1.5% by dry weight to the fiber surfaces.

In Comparative Example 2, the same procedures as in Example 4 were carried out except that the polyethylene-imine treatment was omitted. The results of the tests are shown in Table 2.

TABLE 2

| Example No. | Resistance to Water | Resistance to Organic solvent | *Bonding property: Amount of adhesive agent adhered to fiber cord (%) | Retension of tensile strength (%) | Peeling strength from rubber matrix (kg/5 cm) |
|---|---|---|---|---|---|
| Example | | | | | |
| 4 | 3 | 3 | 5.1 | 98 | 15.9 |
| 5 | 3 | 3 | 4.9 | 97 | 16.5 |
| 6 | 3 | 3 | 5.0 | 98 | 17.1 |
| Comparative Example | | | | | |
| 4 | 1 | 1 | 5.1 | 98 | 8.3 |

Note:
*The amount of polyethyleneimine on the fiber surfaces was determined by elementary analysis.

Table 2 clearly shows that the surface-modified fiber cords of the present invention exhibited an excellent peeling strength of about twice that of Comparative Example 4.

COMPARATIVE EXAMPLE 5

The same procedures as in Example 4 were carried out except that the bentonite treatment was omitted.

It was found that the peeling strength of the resultant bonded cord from the rubber matrix was less than 14 kg/5 cm, regardless of the type and amount of the polyethyleneimine adhered to the fiber surfaces.

EXAMPLES 7 TO 13 AND COMPARATIVE EXAMPLE 6 TO 14

In each of Examples 7 to 13 and Comparative Examples 6 to 14, a wholly aromatic polyamide copolymer produced from 25 molar % of p-phenylene diamine 50 molar % of terephthalic acid dichloride and 25 molar % of 3,4'-diaminodiphenylether was converted by a usual spinning method to an undrawn multifilament bundle having a yarn count of 1500 denier/1000 filaments.

The multifilament bundle was impregnated with an aqueous dispersion containing 1% by weight of fine inorganic particles consisting of 80 parts by weight of talc (hydrated magnesium silicate) particles and 20 parts by weight of hydrated aluminum silicate and having a particle size of 3 μm or less, and the impregnated multifilament bundle was dried by blowing hot air at a temperature of 300° C., so that the multifilament bundle was impregnated with about 1% by weight of dry particles.

The dried undrawn multifilament bundle was drawn, before winding, on a heating plate having a length of 200 cm, at a temperature of 360° C. and a draw ratio of 2.0, and then on another heating plate having a length of 300 cm, at a temperature of 500° C. and a draw ratio of 5.0.

The resultant drawn multifilament bundle had a yarn count of 500 denier/333 filaments.

The above-mentioned aqueous dispersion of the fine inorganic particles was prepared by mixing the talc particles having an average size of 3 μm with hydrated aluminum silicate particles having an average size of 3 μm and available under a trademark of Osmos N, made of Shiraishi Kogyo K.K., uniformly dispersing the mixture in an aqueous solution containing 3% of sodium hexametaphosphate based on the total weight of the fine inorganic particle mixture, while stirring the dispersion.

The fine inorganic particle-adhered multifilament bundle was further impregnated with an aqueous solution containing 3% by weight of γ-glycidoxypropyltrimethoxysilane, which was available under a trademark of Dianasilane GLYMO, made of Dynamite Nobel Co., and the further impregnated multifilament bundle was dried by blowing hot air at a temperature of 130° C. for 120 seconds. The amount of the γ-glycidoxypropyltrimethoxysilane adhered to the multifilament bundle was 0.3 to 1.5% based on the weight of the non-modified multi-filament bundle. A surface-modified multifilament bundle was obtained.

The surface-modified multifilament bundle was cut to form short fibers having a length of 2 to 6 mm.

The short fibers were converted to a paper-like sheet containing 5% to 20%, based on the total weight of the short fibers, of a binder consisting of 80% to 95% by weight of an water-soluble epoxy resin and 5% to 20% by weight of a water-soluble melamine-formaldehyde resin. The sheet was calendered by a pair of calender rolls.

The resultant short fiber paper-like sheet was usable as a substrate for an epoxy resin-impregnated prepreg, a polyimide resin-impregnated pregreg or a cyanurate resin-impregnated pregreg.

The base material, i.e., the paper-like sheet, was subjected to a tensile strength test in a dry condition, a tensile strength test in a DMF-wetted condition, and a bulk density test.

In the tensile strength test in the dry condition, a dry specimen having a width of 15 mm and a testing length of 100 mm was stretched at a speed of 100 mm/min.

In the tensile strength test in the DMF-wetted condition, 4 ml of dimethylformamide was dropped in the center portions of a specimen having the same dimensions as mentioned above, by using an injection, and five seconds after the dropping, the wetted specimen was stretched in the same manner as mentioned above.

The results are shown in Table 3.

TABLE 3

| Item Example No. | Average size of fine inorganic particles (μm) | Amount of γ-glycidoxypropyl-trimethoxysilane adhered to fiber surfaces (% by wt) | Composition of binder: Water-soluble epoxy resin | Composition of binder: Water-soluble melamin resin | Amount of binder (% by wt) | Tensile strength of paper-like sheet: Dry condition (kg/15 mm) | Tensile strength of paper-like sheet: DMF-method condition (kg/15 mm) | Bulk density (g/cm³) | Processability |
|---|---|---|---|---|---|---|---|---|---|
| Comparative Example | | | | | | | | | |
| 6 | 10 | 0.5 | 92 | 8 | 18 | — | — | — | (*)3 Difficult due |
| 7 | 4 | 0.5 | 92 | 8 | 18 | 3.2 | — | 0.30 | to numerous fluffs |
| Example | | | | | | | | | |
| 7 | 3 | 0.3 | 92 | 8 | 18 | 4.7 | 2.8 | 0.41 | good |
| 8 | 3 | 0.5 | 92 | 8 | 18 | 4.9 | 3.1 | 0.42 | good |
| 9 | 3 | 1.5 | 92 | 8 | 18 | 5.0 | 3.3 | 0.42 | good |
| 10 | 3 | 0.5 | 80 | 20 | 18 | 4.4 | 3.0 | 0.40 | good |
| 11 | 3 | 0.5 | 95 | 5 | 18 | 5.2 | 3.5 | 0.44 | good |
| Comparative Example | | | | | | | | | |
| 8 | 3 | 0.5 | 96 | 4 | 18 | 4.2 | 1.8 | 0.40 | Slightly difficult due to fluffs |
| 9 | 3 | 2.5 | 79 | 21 | 18 | 3.8 | 1.4 | 0.38 | Slightly difficult due to fluffs |
| 10 | — | 0.5 | 92 | 8 | 18 | 4.2 | 0.8 | 0.40 | Difficult due to numerous fluffs |
| 11 | — | 1.5 | 92 | 8 | 18 | 4.1 | 0.7 | 0.41 | Difficult due to numerous fluffs |
| 12 | — | 0 | 92 | 8 | 18 | 4.2 | 0.5 | 0.42 | Difficult due to numerous fluffs |
| Example | | | | | | | | | |
| 12 | 3 | 0.5 | 92 | 8 | 20 | 4.9 | 3.1 | 0.43 | good |
| 13 | 3 | 0.5 | 92 | 8 | 5 | 4.1 | 2.9 | 0.39 | good |
| Comparative Example | | | | | | | | | |
| 13 | 3 | 0.5 | 92 | 8 | 22 | 4.3 | 1.8 | 0.40 | Slightly difficult due to fluffs |
| 14 | 3 | 0.5 | 92 | 8 | 3 | *2 | *2 | — | Slightly difficult |

TABLE 3-continued

| Item Example No. | Average size of fine inorganic particles (μm) | Amount of γ-glycidoxypropyl-trimethoxysilane adhered to fiber surfaces (% by wt) | Composition of binder: Water-soluble epoxy resin | Composition of binder: Water-soluble melamin resin | Amount of binder (% by wt) | Tensile strength of paper-like sheet: Dry condition (kg/15 mm) | Tensile strength of paper-like sheet: DMF-method condition (kg/15 mm) | Bulk density (g/cm³) | Processability |
|---|---|---|---|---|---|---|---|---|---|
| | | | | | | | | | due to fluffs |

Note:
*2 Paper-like shape cannot be maintained
(*)3 In spinning step, a number of fluffs were formed.

The processability of the laminate board was tested in a manner such that a round hole having a diameter of 2 mm was formed in a laminate board having a thickness of 0.4 mm by drilling, and the conditions of the hole were observed. It was found that, in the laminate boards of Examples 7 to 13, the holes were easily formed and the inside faces of the holes were smooth.

As Table 3 clearly shows, the modified surfaces of the fibers of the present invention exhibited an enhanced bonding property to the binder containing the water-soluble melamine resin.

We claim:

1. A surface-modified wholly aromatic polyamide fiber, comprising:

a fiber matrix comprising a wholly aromatic polyamide material formed by a spinning (fiber-forming) step, at least one drawing step, and at least one heat-treating step;

fine inorganic particles comprising at least one cation-exchanging inorganic material and embedded in a surface portion of the fiber matrix by applying the particles to a surface portion of the fiber matrix while the fiber matrix is softened or plasticized at any stage after the spinning step to allow the particles to be embedded in the softened or plasticized fiber matrix surface position; and an additive comprising at least one epoxy-containing amino compound selected from the group consisting of tetraepoxy compounds of xylylene diamines, tetraepoxy compounds of cyclohexylene diamines, tetraepoxy compounds of diethylenetriamine, and tetraepoxy compounds of aromatic diamines, the additive having been attached to the fine cation-exchanging inorganic particles by treatment of the fine inorganic particles embedded in the surface portion of the fiber matrix with said additive.

2. The surface-modified wholly aromatic polyamide fiber as claimed in claim 1, wherein the wholly aromatic polyamide material comprises at least one type polymer having 80 to 100 molar % of principal recurring units of the formula (1):

$$—NH—Ar_1—NHCO—Ar_2—CO— \quad (1)$$

wherein $Ar_1$ and $Ar_2$ represent respectively and independently from each other a member selected from the group consisting of the ingredients of the formulae:

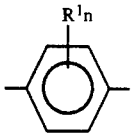

(A)

-continued

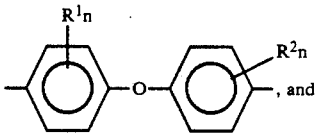

(B)

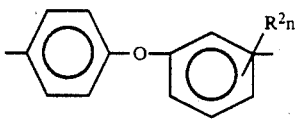

(C)

in which $R^1$ and $R^2$ represent respectively and independently from each other a member selected from the group consisting of halogen atoms and lower alkyl radicals having 1 to 2 carbon atoms, and n represents zero or an integer of 1 to 4.

3. The surface-modified wholly aromatic polyamide fiber as claimed in claim 2, wherein said principal recurring units of the formula (1) comprise the ingredients of the formulae (A) and (B) in the total content of 80 to 100 molar % and the ingredient of the formula (B) is in a content of 10 to 40 molar % based on the total content of the ingredients represented by $Ar_1$ and $Ar_2$.

4. The surface-modified wholly aromatic polyamide fiber as claimed in claim 1, wherein the fine inorganic particles have a size of 0.01 to 5 μm.

5. The surface-modified wholly aromatic polyamide fiber as claimed in claim 1, wherein the fine inorganic particles are in an amount of 0.1 to 5% based on the weight of the fiber matrix.

6. The surface-modified wholly aromatic polyamide fiber as claimed in claim 1, wherein the cation-exchanging inorganic material comprise at least one member selected from the group consisting of silica-alumina, silica-magnesia, bentonite, kaolin, fuller's earth, activated clay, montmorilonite, halloysite, talc, and mixture of an inorganic material comprising, as a major component, hydrated magnesium silicate and a hydrated gel-forming inorganic material.

7. The surface-modified wholly aromatic polyamide fiber as claimed in claim 6, wherein the hydrated gel-forming inorganic material comprises aluminum silicate as a major component.

8. The surface-modified wholly aromatic polyamide fiber as claimed in claim 1, wherein the additive is in an amount of 0.1% to 5% based on the weight of the fiber matrix.

9. A method of producing the surface-modified wholly aromatic polyamide fiber of claim 1, comprising:

converting a wholly aromatic polyamide material to a fiber matrix through a spinning (fiber-forming)

step, at least one drawing step and at least one heat-treating step; and at any stage after the spinning step, applying fine inorganic particles comprising at least one cation-exchanging inorganic material to a surface of the fiber matrix while the fiber matrix is softened or plasticized to allow the particles to be embedded in the softened or plasticized fiber matrix surface portion; and thereafter treating the fine inorganic particles adhered to the surface of the fiber with an additive comprising at least one epoxy-containing amino compound selected from the group consisting of tetraepoxy compounds of xylylene diamines, tetraepoxy compounds of cyclohexylene diamines, tetraepoxy compounds of diethylenetriamine, and tetraepoxy compounds of aromatic diamines, to cause the additive to be attached to the fine inorganic particles.

* * * * *